United States Patent [19]

Raudat

[11] Patent Number: 4,569,181

[45] Date of Patent: Feb. 11, 1986

[54] CASE FEED FOR CONTINUOUS MOTION PACKER

[75] Inventor: John L. Raudat, North Madison, Conn.

[73] Assignee: Standard-Knapp, Inc., Portland, Conn.

[21] Appl. No.: 579,215

[22] Filed: Feb. 10, 1984

[51] Int. Cl.[4] ..... B65B 1/04

[52] U.S. Cl. ..... 53/251; 53/534; 53/539; 53/247; 198/461; 198/570; 198/577

[58] Field of Search ..... 53/247-249, 53/250, 251, 272, 381 R, 534, 539; 198/461, 570, 575, 577, 579

[56] References Cited

U.S. PATENT DOCUMENTS

| | | | |
|---|---|---|---|
| 2,840,224 | 6/1958 | Lefief | 198/461 |
| 2,986,263 | 5/1961 | Jones | 198/461 |
| 3,254,778 | 6/1966 | Marland et al. | 198/579 X |
| 3,339,701 | 9/1967 | Weichhand | 198/575 X |
| 4,040,512 | 8/1977 | Ness | 198/460 |
| 4,457,121 | 7/1984 | Johnson et al. | 53/247 X |
| 4,459,794 | 7/1984 | Raudat | 53/247 X |

*Primary Examiner*—John Sipos
*Assistant Examiner*—Steven P. Weihrouch
*Attorney, Agent, or Firm*—McCormick, Paulding & Huber

[57] ABSTRACT

A rotary packer has pendulously supported grids spaced around a circular orbit that includes a discharge station where each grid mates with a case to be loaded with articles dropped from the grid. Two adjacent grids are required to be so mated, at least during movement of one grid toward and the other grid out of the discharge station. The cases are moved at matching speeds by advancing the odd numbered cases with a first case conveyor and providing a second case conveyor for the even numbered cases.

10 Claims, 18 Drawing Figures

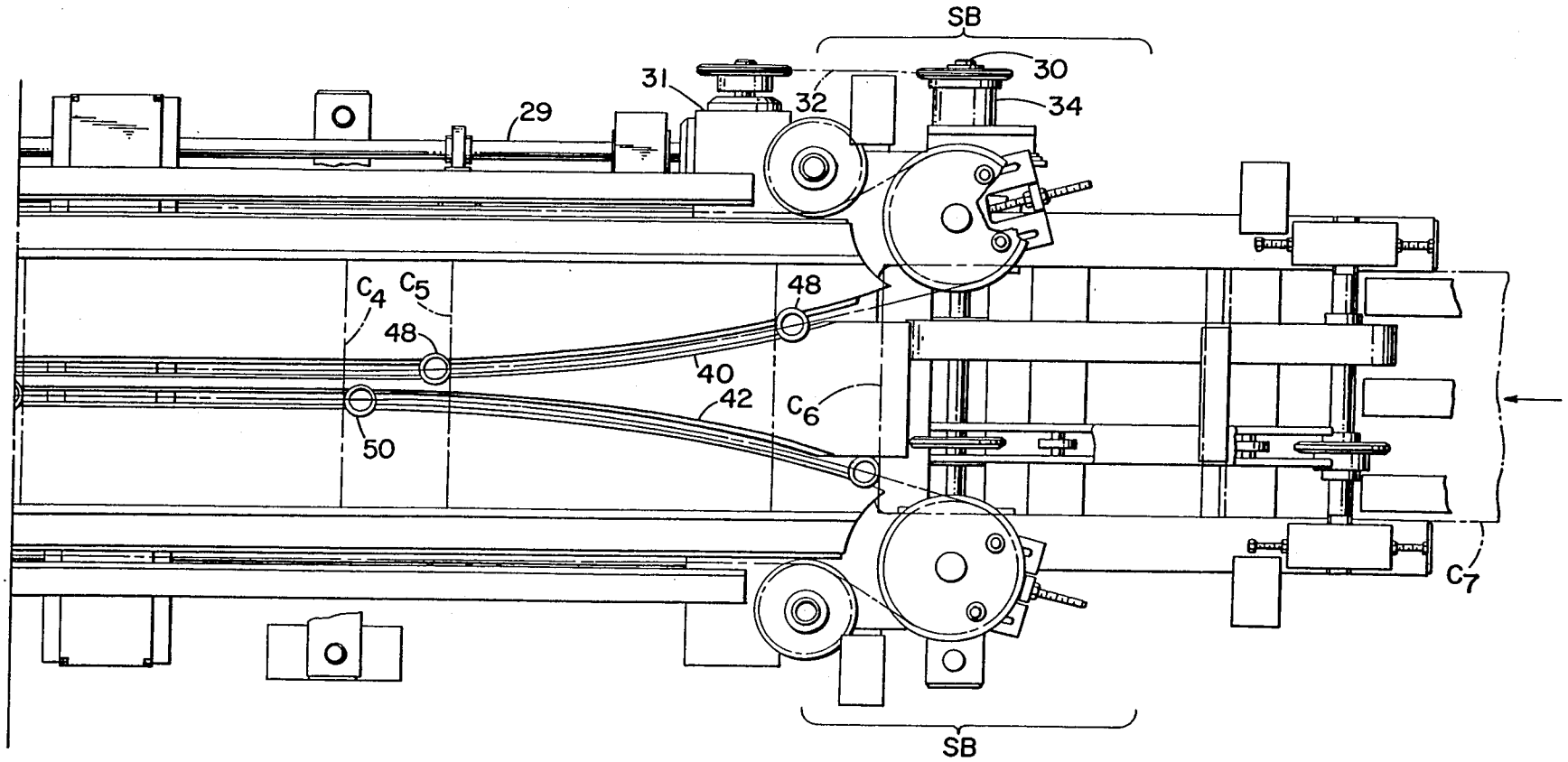
FIG. IA
FIG. I
| FIG. IB | FIG. IA |
|---|---|

CASE FEED FOR CONTINUOUS MOTION PACKER

BACKGROUND OF THE INVENTION

This invention relates generally to systems for handling groups of articles suitably segregated into groups of a size adapted to fill one of a continuous line of packing cases being fed continuously through a discharge station associated with a rotary packer. Each article group moves around a circular orbit from an infeed station to the discharge station where each group is drop packed into an upwardly open case. More particularly, this invention relates to the means for feeding the cases seriatim through the discharge station so that each case is sequentially accelerated and decelerated in a manner that matches the horizontal velocity component of the orbiting article group in an associated grid with the speed of the case to be filled.

The case feed conveyor system to be described herein is especially adapted for use with a continuous motion bottle packer of the type shown in a pending application entitled "Continuous Motion Bottle Packer", Ser. No. 425,104, filed Sept. 27, 1982 and assigned to the assignee herein since issued under U.S. Pat. No. 4,457,121, July 3, 1984. This pending application shows a plurality of grids provided in a rotary structure which is adpated to move each grid in turn through an article infeed station where groups of articles are fed into one of these grids without interrupting either the forward speed of the article group or that of the grid itself. The rotary packer moves each grid in turn through a discharge station where these groups of articles are dropped into upwardly open packing cases.

Both the infeed and discharge stations of such a continuous motion packer operate without interrupting motion of the articles or movement of the packing case being filled. The disclosure in said pending application is incorporated by reference herein. However, a brief description of the overall rotary packer is included for reference purposes.

The continuous motion bottle packer disclosed in said pending application includes article conveyor means for advancing the articles continuously in side-by-side columns along a first horizontal path. These articles are arranged in end-to-end relationship between lane dividers, and means is provided for forming groups of these articles, corresponding to the capacity of the cases to be packed. Another copending application Ser. No. 565,754 is also incorporated herein and was filed Dec. 27, 1983 and illustrates a preferred means for grouping the articles. Although such grouper means does not comprise an essential element of the present invention and need not be described in detail herein a brief summary is provided for clarity. In its preferred form the grouper includes at least two sets of conveyor means, each of which has flight bars with projecting pins so that the chains can be driven in timed relationship with a pocket chain or lug conveyor to advance the grouped articles through the infeed station. Each chain set is driven at a variable speed so that the projecting pins on each chain set follow distinct a cycles as the chains move the flight bar mounted pins around a closed orbit that includes a common upper run so oriented that all of the pins move in the same path and in the same direction as the advancing articles. Differential means couples one chain set to the other so that the said other chain set and its pins move in the same orbit but at a speed which varies inversely to that of the one chain set and its associated pins. The pins on the flight bars associated with each chain set are preferrably provided in staggered relationship to one another to establish the pitch distance between their associated pins. Means is preferably provided for adjusting the pitch of these pins relative to one another to accommodate predetermined numbers and/or sizes of articles within the article groups.

The infeed station of the rotary packer is provided at the downstream end of the lane conveyors and includes spaced cantilevered fingers for slidably receiving the columns of articles with the fingers being so spaced as to define horizontally extending openings therebetween. A plurality of grid structures are rotatably supported in the packer frame and each grid is adapted to pass upwardly through these finger openings as a result of the unique construction for these grids. Each grid consists of longitudinally extending support rails which carry corner posts defining pockets for the individual articles. Front and rear cross members of each grid structure support the ends of each rail, and the corner posts have upper portions which fit between adjacent articles in the advancing article group as each grid moves upwardly through the infeed station.

The grid structures move in a circular orbit oriented in a vertical plane and the tangential direction of movement for the grid structures entering the infeed station forms an acute angle with the horizontal path of the articles themselves as they arrive at the infeed station. The horizontal component of the tangential velocity vector for the grid structures is such that it matches the horizontal speed of the articles moving into the infeed station. Thus, a slight acceleration of the grid and articles entrained therein is achieved as the grid moves away from the infeed station because the tangential speed of the grid does exceed the linear speed of the articles moving into the infeed station. The infeed station is located near the top of the circular orbit.

Each grid structure includes pivotable vanes for engaging and supporting the undersides of the articles held in the grid, and these vanes also serve to slidably support the articles as they are received in the grid at the infeed station. A smooth transition is thereby provided for the motion of the articles as they are accelerated from the straight line infeed direction to the slightly faster circular orbital speed. Each grid is pivotably supported in the rotating grid support structure so that it remains in a horizontal orientation as it travels around the 180 arc of the circular orbit to a discharge station.

The discharge station is defined at the low point of the orbit, and case conveyor means, to be described, presents upwardly open cases sequentially to the discharge station. Although the copending application referred to above discloses the general concept of driving this case conveyor at a speed which varies cyclically to correspond to the horizontal component of motion for the orbiting grid structures, a problem can be encountered when many (N) grid structures are provided in the rotary packer. Whereas the copending application discloses that it is possible to match the horizontal component of velocity of a single grid moving through the discharge station the present invention seeks to solve the problem of how to accommodate and match the speeds of two adjacent grid structures as they move one after the other in close sequence through such a discharge station.

Slightly ahead of the low point in the orbit the pivoted vanes of each grid are retracted into vertical alignment with the grid rails, and the articles are allowed to free fall into an upwardly open packing case moving in timed relationship with the grid, and located immediately below the grid in the case conveyor system. A funnel structure is preferably provided in each grid for guiding the articles into the packing case and the funnel structure comprises depending fingers which must mate with the case to guide and to control the descending articles as they drop into the case. These fingers of the funnel structure also serve to decelerate the articles as they are so dropped in guided fashion, all without interrupting the motion for the articles and of the packing cases.

The chief aim of the present invention then is to provide an improved system for handling the cases whereby adjacent cases in the line of cases move in the same direction but at a speed which changes instantaneously, one relative to another.

SUMMARY OF THE INVENTION

This invention resides in a continuous motion packer of the type having at least N article transporting grids moving around a closed circular orbit such that each grid has a velocity component in the direction of motion of a line of packing cases moving seriatim generally below the vertically oriented orbit. Each grid is pendulously supported in the rotary packer structure so that it is adapted to pass through a discharge station located at the low point of the orbit. More particularly, this invention deals with the improvement to such a continuous motion packer wherein at least two case conveyors are driven in timed relationship with one another but at speeds which vary relative to one another so that their common runs pass parallel to one another and move associated packing cases to and through, and finally out of, the discharge station. The drive means for one of such case conveyors sequentially accelerates and decelerates selectively spaced cases in the line of cases in order to match the horizontal component of velocity of one grid as that particular grid approaches, moves through, and departs the discharge station. Drive means is associated with a second one of at least two such case conveyors for similarly accelerating and decelerating other of said cases located intermediate said selectively spaced cases. These other cases in the line are located adjacent the selectively spaced cases so that adjacent cases in the line have velocities which are similarly matched to an associated grid, but so that these adjacent cases in the line are adapted to move at speeds that differ from one another instantaneously. Stated differently, the line of cases move continuously in a given direction (that is horizontally to and through the discharge station) but individual cases within the line are adapted to move toward and away from one another so as to accommodate differences in the horizontal component of velocity of adjacent grids in the rotary packer structure itself.

BRIEF DESCRIPTION OF THE DRAWINGS

FIG. 1 is a compositive of FIGS. 1A and 1B.

FIG. 1A is a plan view illustrating the upstream end of a case conveyor system constructed in accordance with the present invention.

DETAILED DESCRIPTION

Figure 4:
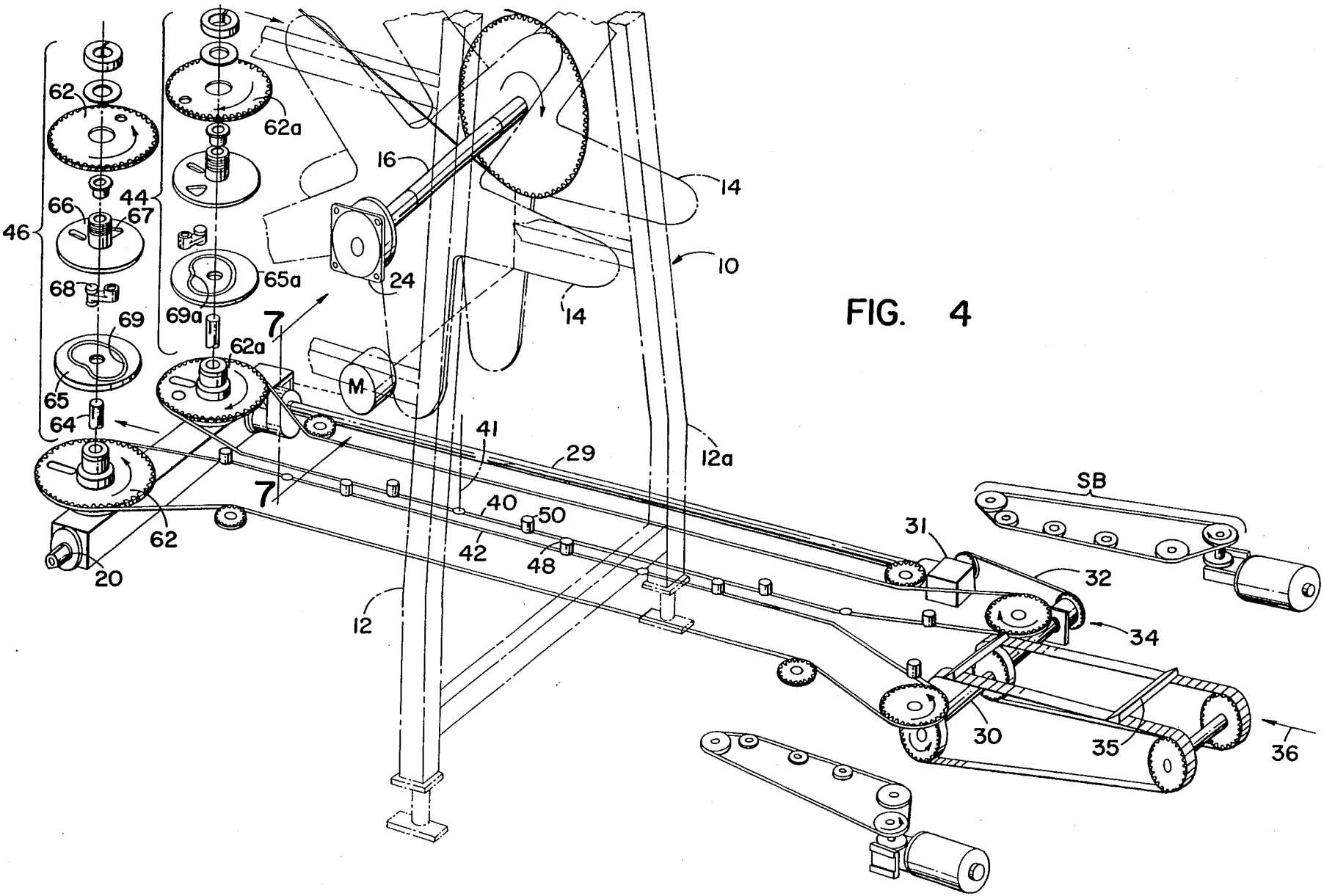
FIG. 4 is a perspective view of the relevant portion of a continuous motion bottle packer of the type shown in the above mentioned patent application, and illustrates in exploded fashion various components thereof to illustrate their relationship to the case conveyor system.

Turning now to the drawings in greater detail, and referring particularly to FIG. 4, a continuous motion rotary packer is illustrated in relevant portion somewhat schematically, and with portions omitted and other portions in exploded relation to better illustrate the elements of the packer which cooperate with the improved case conveyor system of the present invention. A fixed framework 10 includes vertical posts, such as illustrated at 12 and 12*a*, which posts rotatably support the rotary ferris wheel structure in which the grids (not shown) are provided. The grids are themselves pivotably supported at circumaxially equally spaced locations as defined in the outer end of radially outwardly projecting arms 14, 14. As described in the above mentioned pending application, several grid structures move in a circular orbit at a constant velocity in their respective support hubs (not shown) and means is provided in the hubs to maintain all the grids in the generally horizontal portions shown in FIGS. 2B, 2C and 2D. Said last mentioned means preferably comprises chains or belts (not shown) which serve to maintain each individual grid structure at horizontal relationship as it moves around the vertically oriented orbit defined by the horizontal wheel axis 16.

Drive means is provided for operating the wheel structure as described in said copending application. A brake is preferably provided on the end of shaft 16 as suggested at 24 to facilitate stopping of the wheel in the event of a malfunction or pursuant to a normal stop sequence. Means is provided for driving shafts associated with the individual lane conveyors, and with the article grouping conveyor system as described in both above mentioned pending applications. The drive means, suggested by the motor M in FIG. 4, operates the article feeding systems which form the article groups at an infeed station (not shown) adjacent the upper periphery of the orbital path for the grid structures.

Figures 3, 3A:
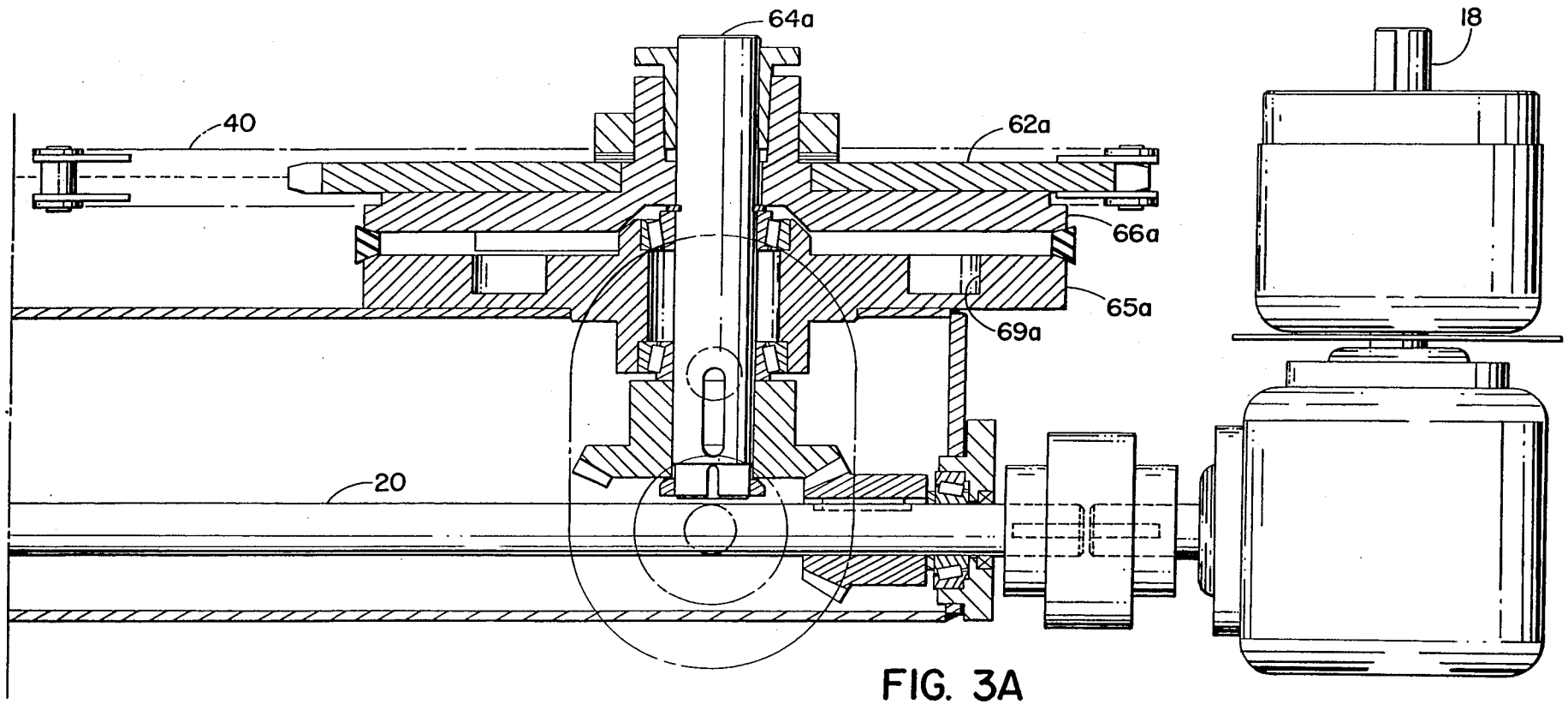
FIG. 3 is a composite view of FIGS. 3A and 3B, and is taken generally on the line 3—3 of FIG. 1B.
FIG. 3A illustrates the right hand portion of the sectional view represented by line 3—3 of FIG. 1B.
Figure 5:
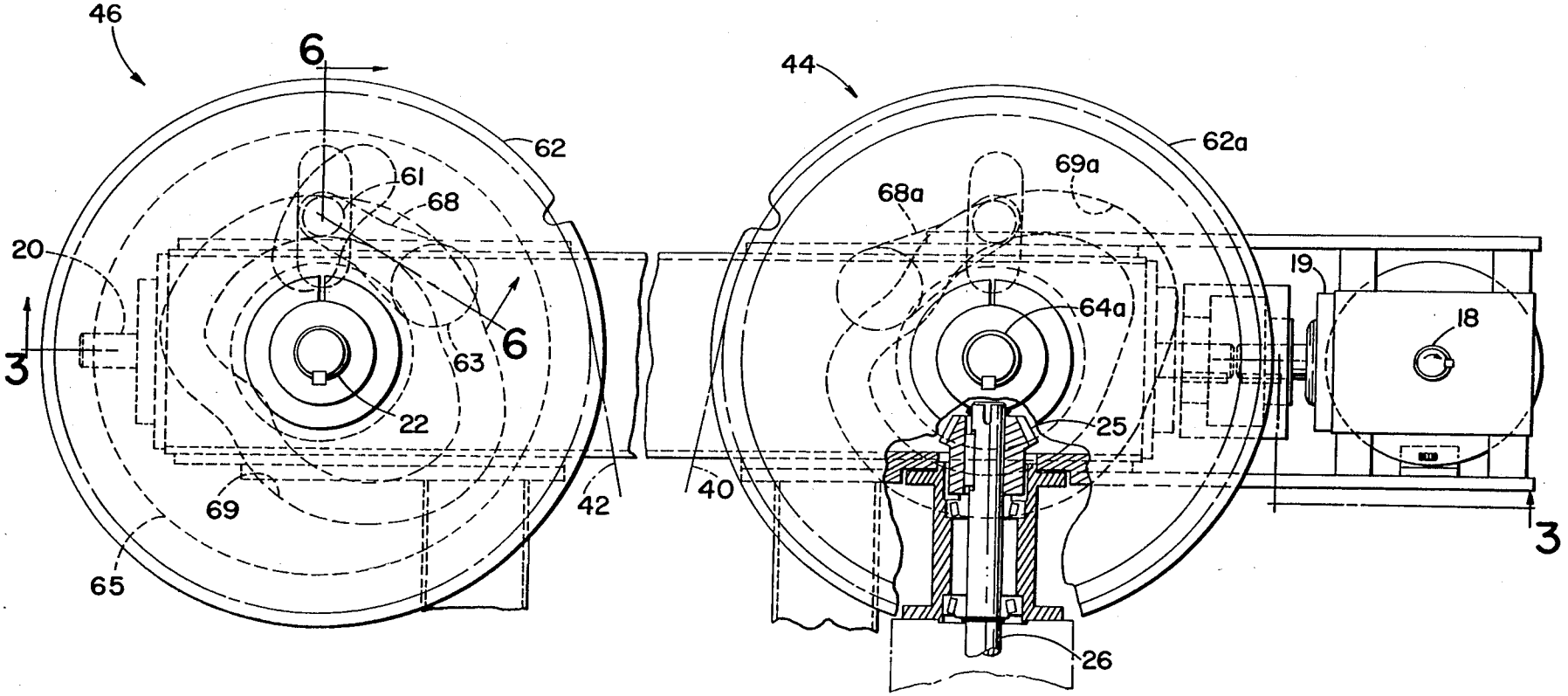
FIG. 5 is a plan view, with portions broken away, of the downstream or exit end of the case conveyor system illustrating the geometry of the cams which drive both the right and left hand case conveyor in synchronism with one another but at speeds which vary relative to one another.

The motor M also drives a cross shaft 20 associated with the case conveyor system to be described herein. As best shown in FIG. 5 an input drive shaft 18 provides the drive for the case conveyors and a right angle drive unit 19 drives cross shaft 20 through a pair of bevelled gears best shown in FIG. 3A and FIG. 3B which bevel gears in turn rotate vertically oriented drive shafts 64 and 64*a* associated with the two case conveyor drive sprockets 23 and 23*a* respectively.

Figure 7:
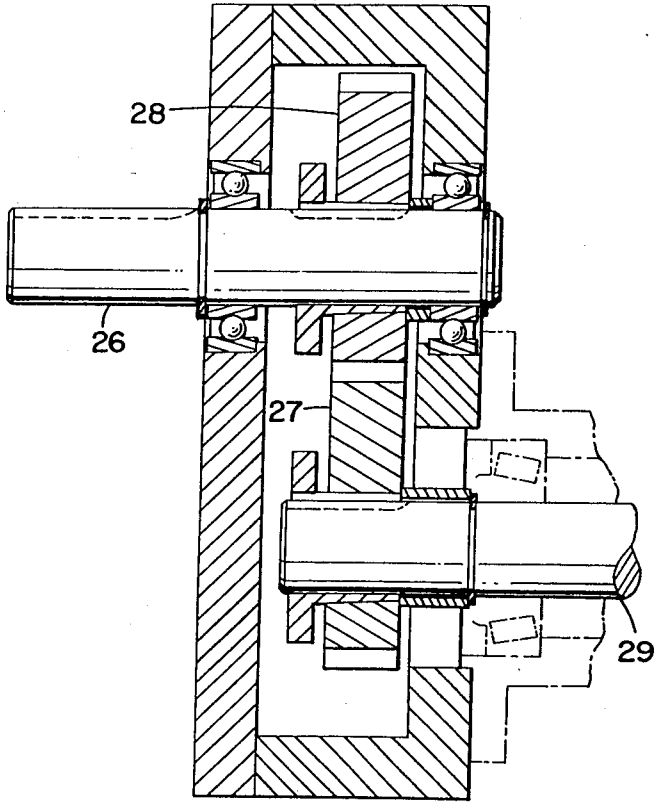
FIG. 7 is a sectional view taken generally on the line 7—7 of FIG. 4.
Figure 8:
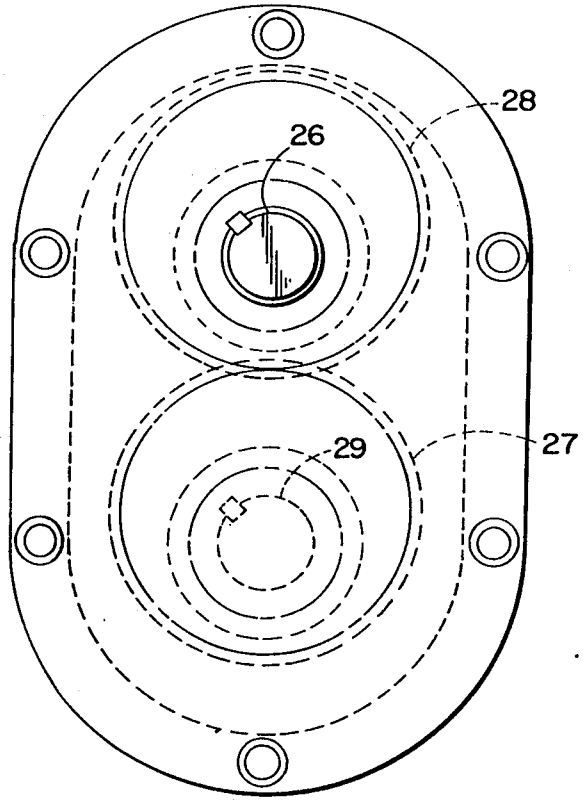
FIG. 8 is a left hand end view of the elliptical gear structure illustrated in FIG. 7.

As shown in FIG. 5 the right hand sprocket 23*a* associated with the right hand case conveyor drive shaft 64*a* has a bevel gear (not shown) that meshes with a bevel gear 25 to turn a longitudinally extending shaft 26. Shaft 26 is also shown in FIG. 7, and serves to rotate one of two elliptical gears 27 and 28 to achieve a variable speed output for shaft 29.

Returning to FIG. 4, shaft 29 extends upstream parallel to the right hand case conveyor and operates case infeed conveyor drive shaft 30 through a right angle gear box 31, timing belt 32, and a case feed control clutch/brake unit 34.

Figures 2, 2A:
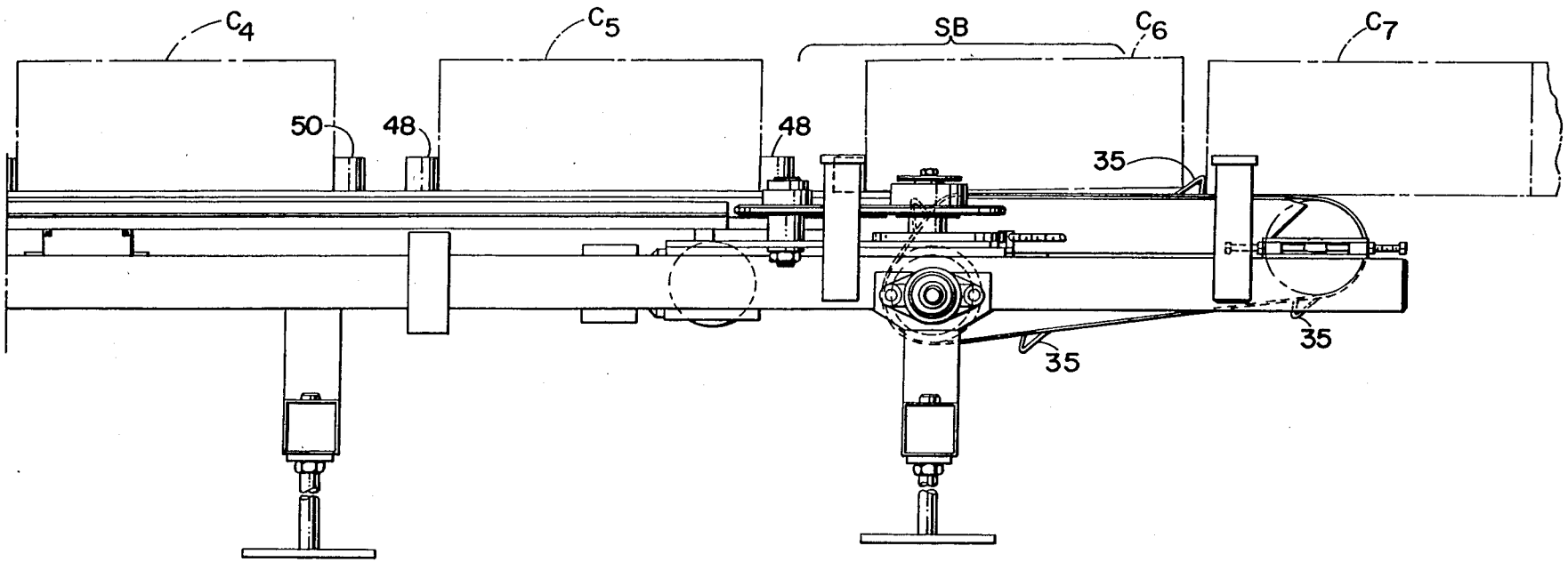
FIG. 2 is a composite of FIGS. 2A and 2B.
FIG. 2A is an elevational view of the upstream end of the case conveyor system as illustrated in FIG. 1A.

Cases are fed in-line, that is one adjacent another in the direction of the arrow 36 in FIG. 4 where each case in turn contacts one of several flight bars 35 associated with the infeed conveyor shown. These flight bars 35, 35 are spaced from one another in the infeed case conveyor by distance less than the longitudinal dimension of the cases to be packed. Thus, bar 35 will be followed by a succeeding bar which lifts the case upwardly and thereby facilitates the separation of the cases one from another so that each can be handled by the case conveyor system to be described, see FIG. 2A. The reader is referred to a pending application Ser. No. 254,638 filed April 16, 1981 now abandoned and entitled "Packing Case Tab Slitter" for a more complete description of the preferred construction for a typical case infeed conveyor suitable for providing a desired separation between adjacent cases. For present purposes it is sufficient to note that the infeed conveyor drive shaft 30 is operated at a speed which varies and is synchronized with the speed of motion of the case conveyors and other parameters for the case conveyor system to be described. The pending application Ser. No. 254,638 is itself a division of Ser. No. 75,324 filed Sept. 12, 1979 now U.S. Pat. No. 4,291,518 and represents a continuation-in-part thereof. This divisional application is incorporated by reference here for purposes of completing the present disclosure.

Figure 1B:
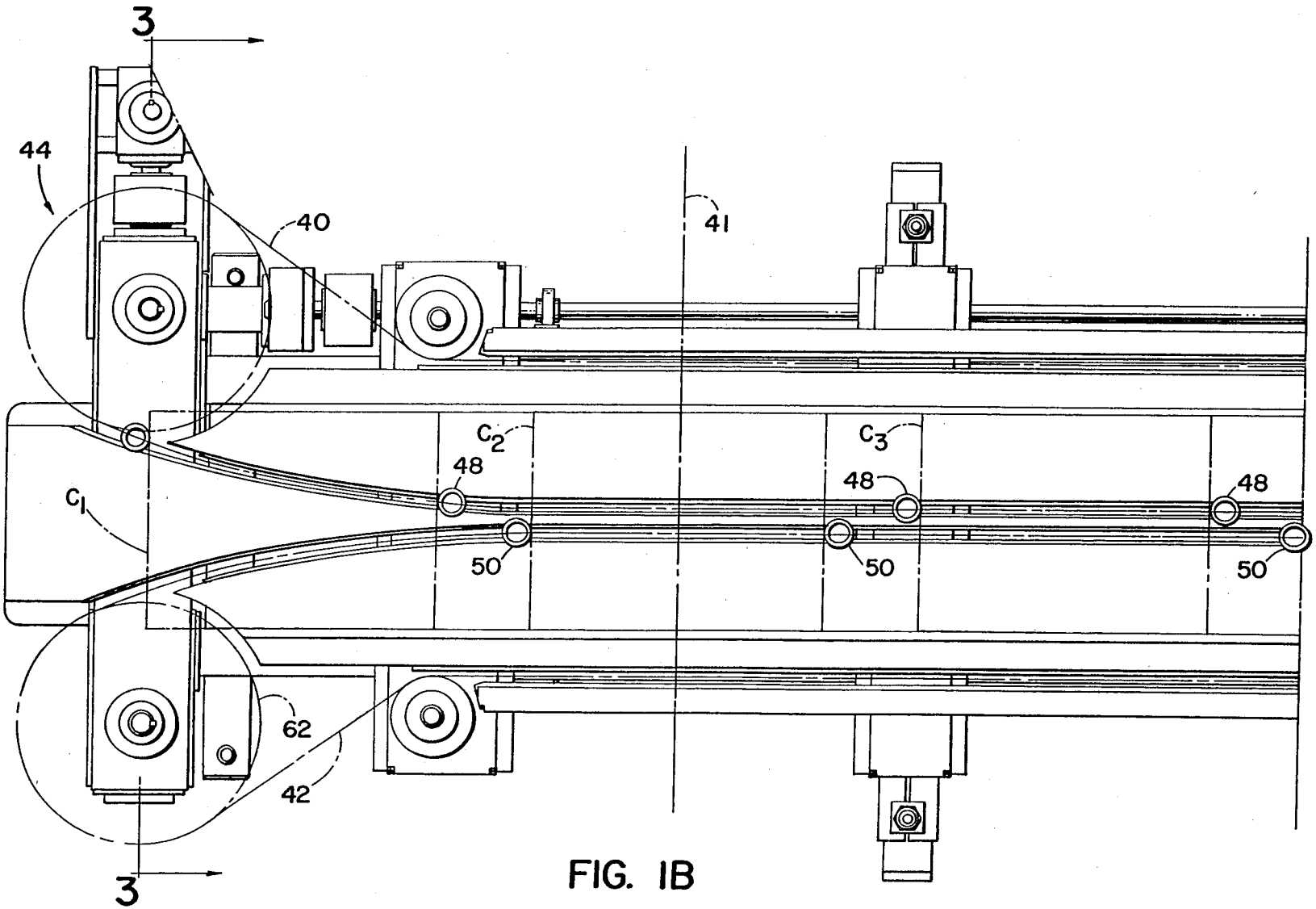
FIG. 1B is a plan view of the downsteam end of the case conveyor system of FIG. 1A, with the laterally extending broken line representing the location for the discharge station associated with the rotary packer.

Turning next to a detailed description of the specific elements of the present invention, it will be apparent that the line of cases advancing in the direction of the arrow 36 will be affected by the infeed conveyor referred to above in that successive cases are spaced one from another as they are fed into the case conveyor system to be described. In lieu of the single case conveyor for handling such cases as disclosed in the prior patent application the present invention contemplates at least two case conveyors having in common parallel active runs 40 and 42 oriented parallel to one another and defining the path of motion for the cases as they move through a vertical plane defined by the discharge station and represented by the broken line 41 in FIG. 4 (and also shown in FIG. 1B and FIG. 2B).

Figure 9:
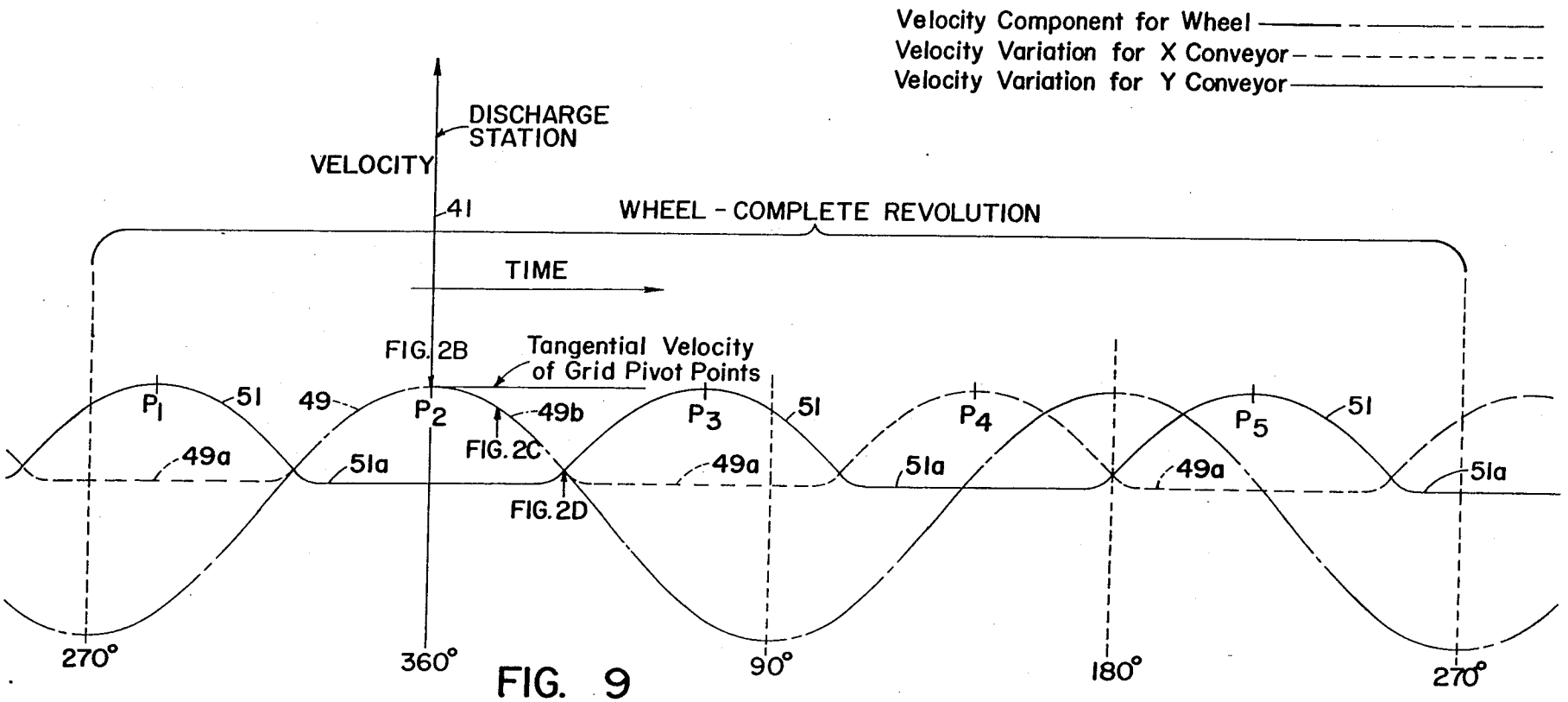
FIG. 9 is a graphical presentation of the variation in horizontal velocity for one of several grid structures provided on the rotary packer and illustrates the variation of the horizontal velocity component thereof in phantom lines for a complete revolution of the rotary grid structure. Also shown in this view are the velocity variations for both the right hand and left hand case conveyors (in broken and solid lines respectively) with the discharge station being indicated by a vertical line at a time corresponding to the position for one of the grids G2 at the instant of time shown in FIG. 2B.

Still with reference to FIG. 4 the right hand case conveyor comprises an endless chain 40 driven from its downstream end as described above through bevel gears associated with cross shaft 20 and through a variable speed drive unit 44, to be described, such that the speed of the lugs 48, 48 associated with the right hand case conveyor chain 40 varies in a cyclical fashion as suggested by the phantom line 49 in FIG. 9. That is, with the case C2 at the discharge station as represented by the vertical line 41 in FIG. 2B, lugs 48, 48 on right hand case conveyor chain 40 move at a maximum speed corresponding at that instant at least to the tangential velocity of the rotary packer wheel and one of its associated grid G2. The speed of the case C2 will have accelerated from some lesser value, represented by a broken line 49*a* in FIG. 9 to the maximum corresponding to the position for case C2 at the discharge station (FIG. 2B) whereupon the case C2 will be decelerated so that at the instant of time represented by FIG. 2C the case will continue to match the horizontal component of speed of movement of grid G2 in the horizontal direction of case movement. This is represented by the portion of the broken line curve 49 illustrated at 49*b*.

In like manner, the left hand case conveyor chain 42 also moves at a speed which varies cyclically so that its lugs 50, 50 follow a speed change variation as represented by the solid line 51 in FIG. 9. For example, at the instant represented by the location for case C1 in FIG. 2B the left hand case conveyor can be seen to be moving case C1 at a speed represented by the line 51*a*, that is at a speed considerably less than the maximum speed associated with the case C2 at the discharge station in FIG. 2B. It will be apparent that case C3 will also move at the same speed as case C1 at any given instant of time since both cases are handled by the same left hand case conveyor chain 42. For the same reason, case C4 necessarily moves at the same instantaneous speed as that of case C2 because these even numbered cases are handled by the right hand conveyor chain 40.

Left hand conveyor chain 42 is driven from shaft 20 through a bevel gear as described above with reference to FIGS. 3A and 3B. A variable speed drive unit 46 much like that referred to previously with reference to the unit 44 also serves to drive the left hand conveyor chain 42 at a speed which also varies cyclically as represented by the solid line 51, 51*a* in FIG. 9. Upon a closer examination of FIG. 9 it will be noted that during a complete revolution for the rotary packer wheel (see the 270 degree markers at the left hand and at the right hand side of FIG. 9). During this wheel revolution left hand conveyor chain 42 moves through three definite peaks represented by the reference numeral P1, P3, and P5. It is also noted that during this same complete wheel revolution conveyor chain 40 will move through two distinct peaks, one at P2 and the other at P4. Therefor, in one complete wheel revolution, or cycle, each of the case conveyor chains 40 and 42 operate in timed relationship with one another and with rotation of the wheel structure so as to provide a number of peaks (in this case 5) corresponding to the number of grids on the wheel structure itself. (This number 5 is of course a special case attributable to the present disclosure, but in the more general sense this number is represented by the letter N in the appended claims).

By way of summary then left hand case conveyor chain 42 follows the solid line illustrated in FIG. 9 by reference numeral 51, 51*a* and defines three peaks P1, P3 and P5 during the single revolution of wheel structure 14 as defined between the vertical lines indicated by the 270 degree indices in this view. Valleys 51*a* associated with this speed variation are achieved by the shape for cam track 69 in the drive unit 46 associated with this left hand case conveyor chain 42. Similarly, the right hand conveyor chain 40 follows a speed variation 49, 49*a* characterized by two peaks (identified by reference numerals P2 and P4) in the FIG. 9 cycle. The valleys 49*a* associated with this speed variation for case conveyor chain 40 are achieved by the shape of cam track 69*a* in case conveyor drive unit 44. The orientation for these cams and their peculiar shape provide the desired variation in speed for the two case conveyor chains 40 and 42.

Figure 2B:
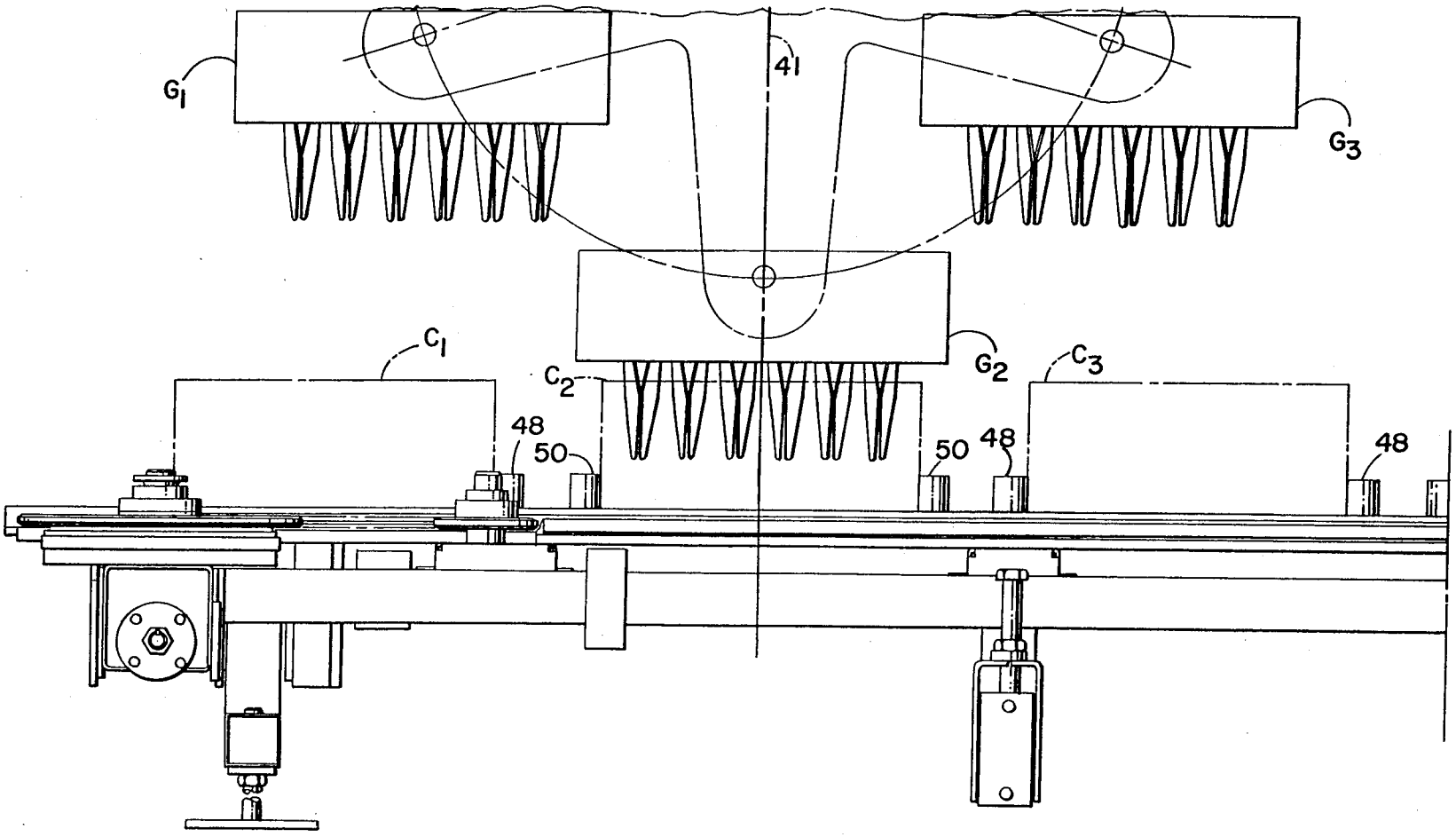
FIG. 2B is an elevational view of the portion of the case conveyor system associated with the discharge station, the latter being illustrated by a vertically extending broken line. The rotary packer structure is also included schematically in this view to show several grid structures.
Figure 2C:
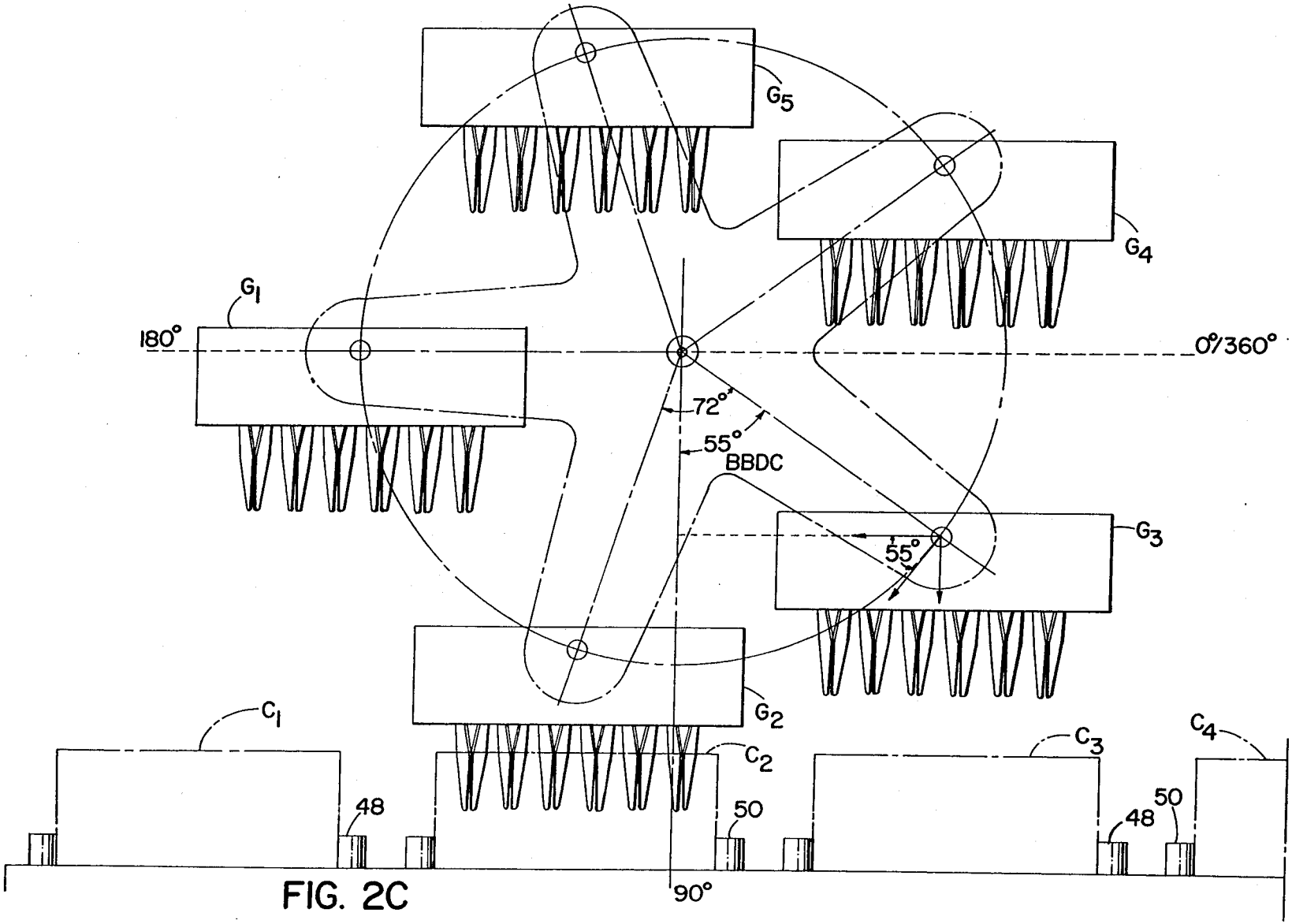
FIG. 2C is a view similar to FIG. 2B but illustrating the relative locations for several adjacent grid structures and cases at a slightly later instant of time.
Figure 2D:
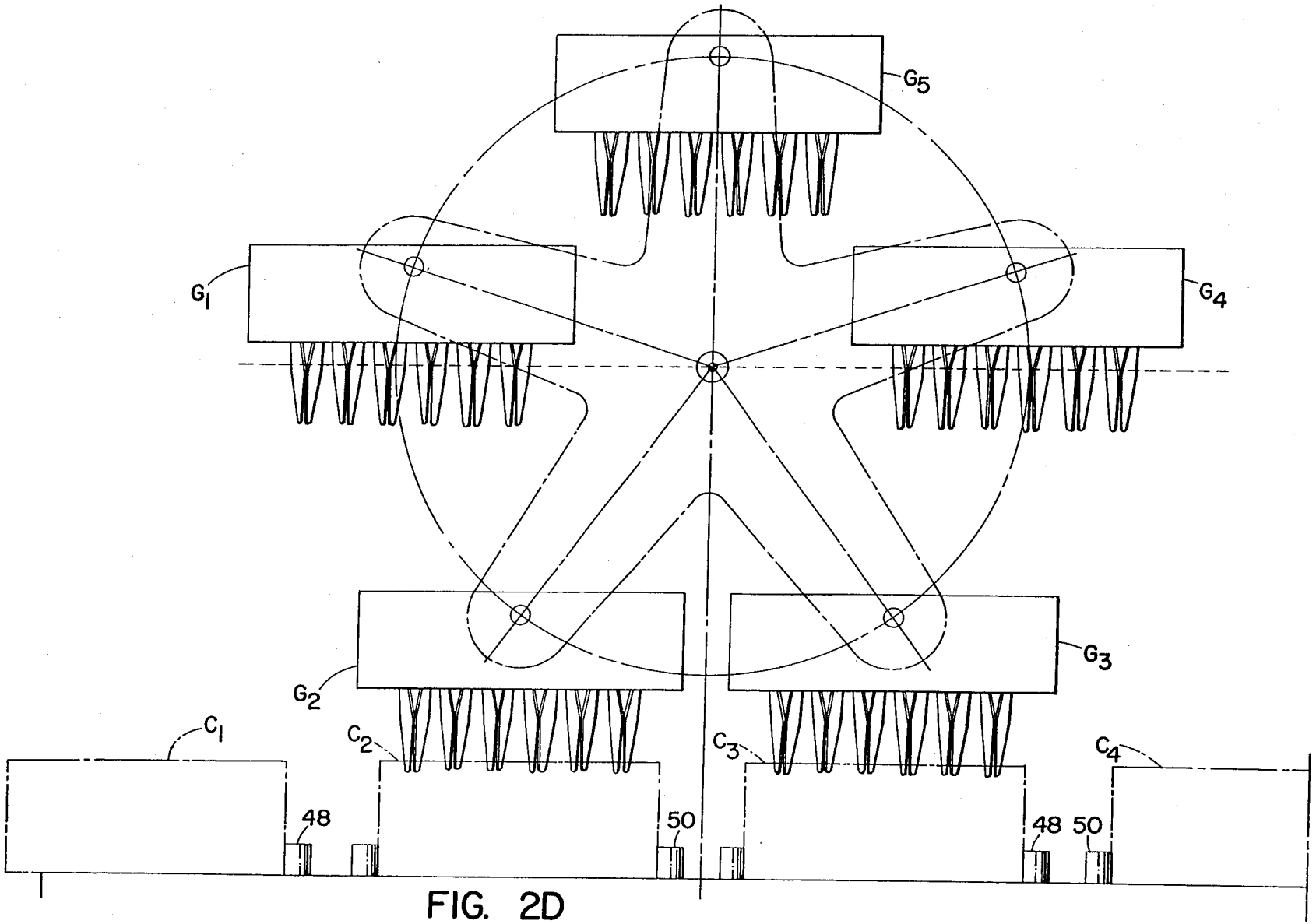
FIG. 2D is a view similar to FIG. 2C, but illustrating the locations for the adjacent grids and cases at a still later instant of time.
Figure 10:
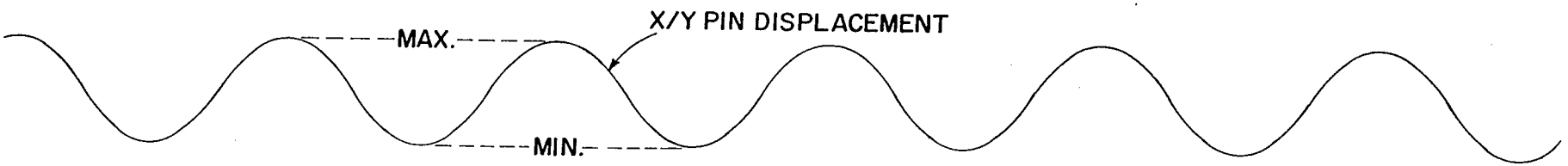
FIG. 10 is a graphical representation of the relative motion resulting between the right hand and left hand case conveyors during the cycle or revolution of the packer grid support structure shown in FIG. 9.

It will be apparent that the phrase difference between the speed variations for the two side-by-side case conveyor chains 40, 42 leads to relative motion between these chains and their associated posts or lugs 48 and 50. This variation in position of the lugs, and hence of the cases relative to one another is illustrated graphically in FIG. 10. FIGS. 2B, 2C and 2D also illustrate this relative motion between the adjacent cases in the line, and FIG. 2D shows the situation at the instant of time where grids G2 and G3 are located in equidistantly spaced relationship relative to the vertical line representing the discharge station. At this instant of time both grid G2 and G3 have the same horizontal component of velocity and it is an important feature of the present invention that cases C2 and C3 also operate at the same instantanous speed. This point is represented by the cross over points between the graphical speed variation lines 49 and 51 in FIG. 9. At this point in time (FIG. 2D) two grids are matched to the speed of two cases. If three grids had to be so matched another case conveyor would be required in addition to the two case conveyors shown and described herein.

Figure 3B:
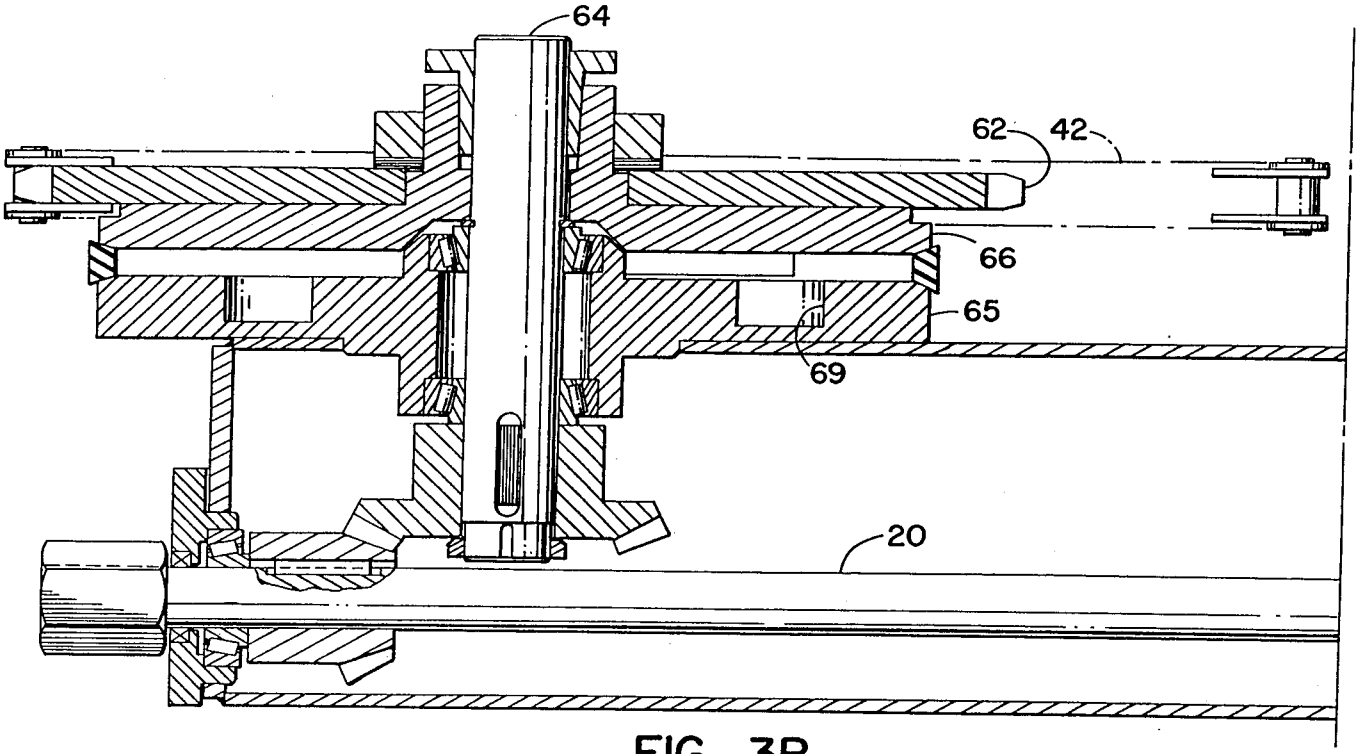
FIG. 3B is a vertical sectional view representing the left hand portion of the line 3—3 in FIG. 1B.
Figure 6:
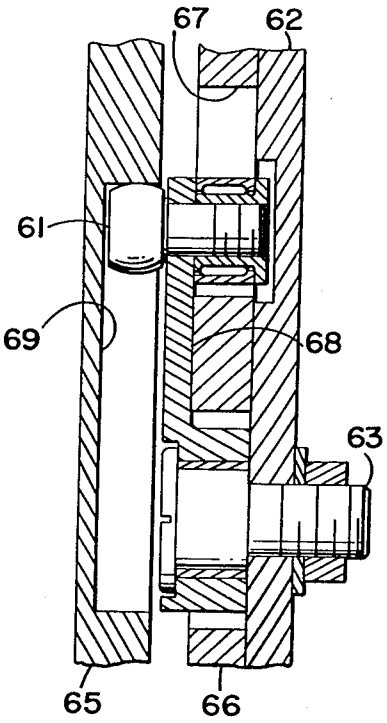
FIG. 6 is a sectional view taken generally on the line 6—6 of FIG. 5.

Units 44 and 46 for achieving this variable speed motion of the two case conveyors are similar to one another, except that they are oppositely disposed and their cams are angularly offset with respect to one another. Therefor, only one need be described in detail herein. The left hand drive chain 42 is driven by sprocket 62 shown in place in FIG. 1B and also shown in the exploded view of FIG. 4 as a component part of variable speed drive unit 46. FIG. 3B shows sprocket 62 and chain 42 together with stub shaft 64 on which the sprocket 62 is rotatably supported by means of drive disc 66. Drive disc 66 is also shown in FIG. 6 and defines a radially extending slot 67 in which a cam follower 61 is provided to achieve relative angular displacement between disc 66 and a cam plate 65. Cam follower 61 is provided on the free end of a crank arm 68, which crank arm is supported by screw 63 in the sprocket 62. Cam plate 65 defines a box cam groove 69 best shown in FIG. 5, which groove provides a programmed change in the relative motion between it and the cam follower 61 as defined by the groove itself and crank arm 68. With particular reference to FIG. 5 and comparing the relative orientation between the left hand cam track 69 in the drive unit 46 associated with the left hand conveyor chain 42, and the similarly shaped but oppositely formed cam track 69*a* for the cam plate and drive unit 44 associated with chain 40 it will be apparent that in addition to being mirror images of one another these cam plates are angularly displaced so as to provide for coordinated and timed handling of the cases which move individually and serially through the dischage station.

With particular reference to FIG. 9 the shapes of the various curves there shown can be visualized as moving from right to left through the vertical line representing the discharge station itself. At the instant shown one case C2 is located at bottom dead center of the orbit (that is at the discharge station represented by the line 41) and at this point in time cases C2, C4 and the even numbered cases are moving at a maximum velocity in the downstream direction. Cases C1, C3, C5 and other odd numbered cases are in turn moving at a slower speed at this particular instant.

The grid G2 in FIG. 2C has moved through the discharge station in this view and therefor the one of the two case conveyors shown with its lugs 48, 48 is slowing down slightly. The downwardly moving grid G3 in FIG. 2C must mate with the case C3 being handled by the other of the two case conveyors shown and therefor case C3 has to be accelerating at this instant of time. FIG. 2D shows the grids G2 and G3 at the time when their speeds are, instantaneously at least, identical.

I claim:

1. In a continuous motion packer of the type having at least N article transporting grids moving around a closed orbit such that each grid has a velocity component in the direction of motion of a line of cases moving seriatim along a path located generally tangential to the orbit and through a discharge station located at a point adjacent to the orbit, the improvement comprising at least two case conveyors having common runs in said path passing parallel one another through the discharge station, drive means for a first one of said at least two case conveyors for sequentially accelerating and decelerating selectively spaced cases in the line to match the horizontal component of velocity of spaced grids as they approach and move through the discharge station and as said spaced grids continue to move out of the discharge station, drive means for a second one of said at least two case conveyors for sequentially accelerating and decelerating other of said cases intermediate said selectively spaced cases to match the horizontal component of velocity of grids intermediate said spaced grids as they approach and move through the discharge station and as said intermediate grids continue to move out of the discharge station, said drive means for said first and second conveyors accelerating and decelerating the case so that adjacent cases in the line have velocities matched with the horizontal component of velocity of their respective grids but so that such adjacent cases in the line move at speeds that differ from one another instantaneously.

2. The combination defined in claim 1 wherein N is at least four and wherein each of said two case conveyors moves every other case respectively in the line of cases into and through said discharge station.

3. The combination defined in claim 1 wherein N is at least five and wherein each of said two case conveyors move every other case respectively in the line into and through said discharge station.

4. The combination defined in claim 1 further characterized by case infeed conveyor means to provide a space between adjacent cases in the line of cases, and each case conveyor including a chain and lugs on the chain defining pockets for the cases, said pockets of said two chains being so spaced relative to one another that each of said two case conveyors receives every other case respectively in the line of cases to move said cases into and through said discharge station.

5. The combination defined in claim 4 further characterized by a wheel structure in which the grids are mounted so that they move in a circular orbit oriented in a generally vertical plane, and said case path being generally horizontal as defined by said common case conveyor runs.

6. The combination defined by claim 5 wherein said grids are pivotably supported at a predetermined radial distance from a horizontal axis of rotation for said wheel structure, and wherein said packer also has means for maintaining all of the grids in a generally horizontal orientation such that the grids remain parallel to said case conconveyor line of motion at least as the grids approach, move through, and then out of the discharge station.

7. The combination defined by claim 6 wherein N is at least four.

8. The combination defined by claim 6 wherein N is at least five.

9. The combination defined by claim 5 wherein at least five grids have a chordal spacing with respect to one another in said wheel structure that any two adjacent grids clear one another as the wheel structure rotates and as said grids are so maintained horizontally, each of said grids having a depending funnel structure with a depth such that the funnel structure penetrates its associated case for coordinated motion therewith into, through, and out of the discharge station, said radial distance for said grids in said wheel structure being related to the depth of said depending grid funnel structure and to the chordal distance between adjacent grids such that at least two adjacent cases are moved at instantaneously independent speeds even as these two adjacent cases are instantaneously penetrated by two adjacent grid funnel structures.

10. The combination defined by claim 9 wherein said drive means for said one and said second case conveyors comprise a common input drive shaft, and two variable speed drive units coupled to said common input drive shaft, each of said units having a cam and a cam follower to achieve the speed variation desired, said cam and followers of said respective units being phase displaced relative to one another to achieve the above described speed variations for said case conveyors.

* * * * *